United States Patent [19]

Meyerand, Jr. et al.

[11] Patent Number: 4,543,484

[45] Date of Patent: Sep. 24, 1985

[54] LASER PARTICLE REMOVAL

[75] Inventors: Russell G. Meyerand, Jr.; David C. Smith, both of Glastonbury, Conn.

[73] Assignee: United Technologies Corporation, Hartford, Conn.

[21] Appl. No.: 466,443

[22] Filed: Feb. 15, 1983

Related U.S. Application Data

[63] Continuation of Ser. No. 208,470, Nov. 19, 1980, abandoned.

[51] Int. Cl.[4] ..... H01J 27/24; B03C 3/38

[52] U.S. Cl. ..... 250/423 P; 250/432 R; 55/101

[58] Field of Search ..... 219/121 FS; 250/423 P, 250/425, 492.1, 284, 288, 432 R, 423 R; 55/101, 102, 107; 356/318

[56] References Cited

U.S. PATENT DOCUMENTS

| | | | |
|---|---|---|---|
| 3,463,591 | 8/1969 | Franken et al. | 356/318 |
| 3,853,750 | 12/1974 | Volsy | 250/432 R |
| 4,035,638 | 7/1977 | Szöke et al. | 250/423 P |
| 4,209,693 | 6/1980 | Fite et al. | 250/425 |
| 4,212,716 | 7/1980 | Rigny | 250/423 P |

OTHER PUBLICATIONS

Weeks, "Interaction of TEA $CO_2$ Laser Radiation with Aerosol Particles", App. Optics, 15, (11), Nov. 1976, pp. 2917–2921.

*Primary Examiner*—Alfred E. Smith
*Assistant Examiner*—Carolyn E. Fields
*Attorney, Agent, or Firm*—Eric W. Petraske

[57] ABSTRACT

Small hot particles contained in fluid stream 101 are partially vaporized by laser 46 and deflected transversely to the direction of flow out of interaction region 45 and into removal duct 65. An alternate embodiment ionizes the particles and deflects them by an electric field.

5 Claims, 4 Drawing Figures

LASER PARTICLE REMOVAL

CROSS REFERENCE TO RELATED APPLICATIONS

This is a continuation of application Ser. No. 208,470, 11/19/80 now abandoned.

DESCRIPTION

1. Technical Field

The invention relates to the use of a high power laser to remove particulate matter from a gas stream.

2. Background Art

In air ventilation systems, exhaust cleaning systems for power plants, coal gasification systems and many others, it is important to remove small particles such as dust or ash from a gas stream. Cyclone separators, air filters and electrostatic precipitators have been developed for certain ranges of particle size and temperature.

In the particular case of gas turbine power plants, where hot gas from a combustion unit drives a turbine, it is important that the expensive turbine blades receive an essentially particle-free gas flow. Cyclone separators are able to remove only relatively large particles. Filters are made that are capable of removing micron sized particles, but even if such filters could withstand high-temperature gas, the large pressure drop that is inherent in a micron sized filter renders such filters impractical for a turbine system. Electrostatic precipitators rely on electric charges naturally present on a particulate matter, but small, hot particles tend to be neutral, so that electrostatic devices alone do not work well.

In the art of laser isotope separation, in which a finely tuned laser beam is selectively absorbed by only one isotope in a chemically pure vapor, a variety of methods have been developed in order to produce a physical separation of isotopic species as a result of differential optical interaction. For example, U.S. Pat. No. 3,558,877 suggests the use of a beam of highly monochromatic light tuned to a particular frequency to transfer momentum to only one of a mixture of isotopes traveling through a vacuum chamber in an atomic beam, so that the desired isotopic species is deflected in a different direction from the remainder of the beam. Another isotope separator is illustrated in U.S. Pat. No. 3,772,519, in which an atomic beam of Uranium is illuminated by a laser beam tuned to a particular wavelength so that $U^{235}$ atoms are excited from the ground state, while $U^{238}$ atoms are not affected. A second laser beam is then used to ionize only the excited $U^{235}$ atoms. This second beam must have energy high enough to ionize the excited atoms but not so high that it will ionize a $U^{238}$ atom directly from the ground state. Other laser isotope separators along the same lines have been suggested, all having the property of employing a finely tuned, highly monochromatic beam that will interact with a single atom or a single molecule (such as Uranium Hexafluoride) in a particular quantum mechanical state. Particulate matter that is macroscopic in the sense that particles contain $10^{10}$–$10^{11}$ atoms has not been considered in the laser art.

DISCLOSURE OF INVENTION

The invention relates to the use of a high power laser for removing small particles from a gas stream. In different embodiments the laser beam may partially vaporize a particle, which is propelled by reaction from the vapor along the laser beam direction; or the laser beam may impose a charge on a particle which may then be removed from the gas stream by electrical means.

The foregoing and other objects, features and advantages of the present invention will become more apparent from the following description of preferred embodiments and accompanying drawings.

BEST MODE FOR CARRYING OUT THE INVENTION

Figure 1:
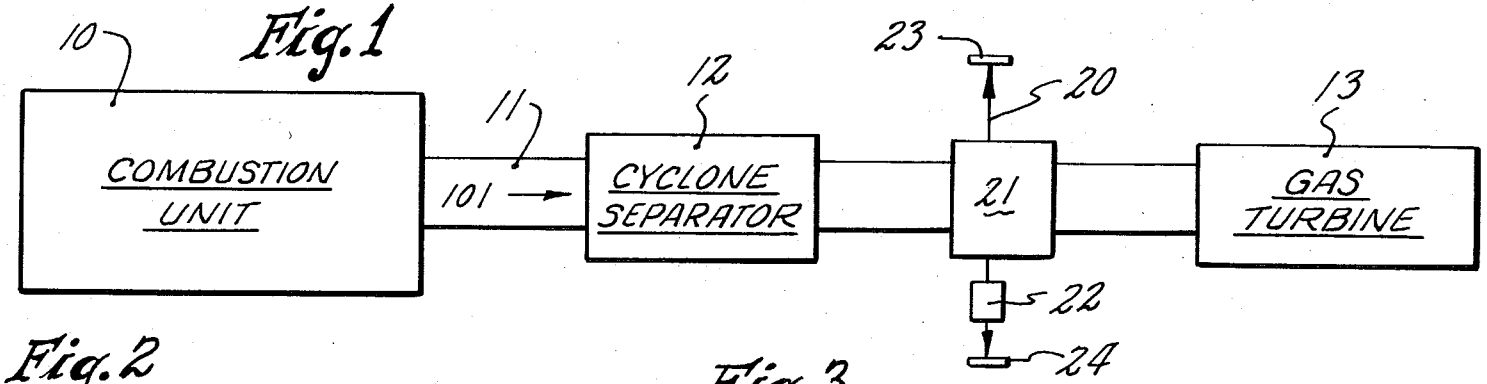
FIG. 1 shows, in partially pictorial, partially schematic form, a power plant incorporating one embodiment of the invention.
Figure 2:
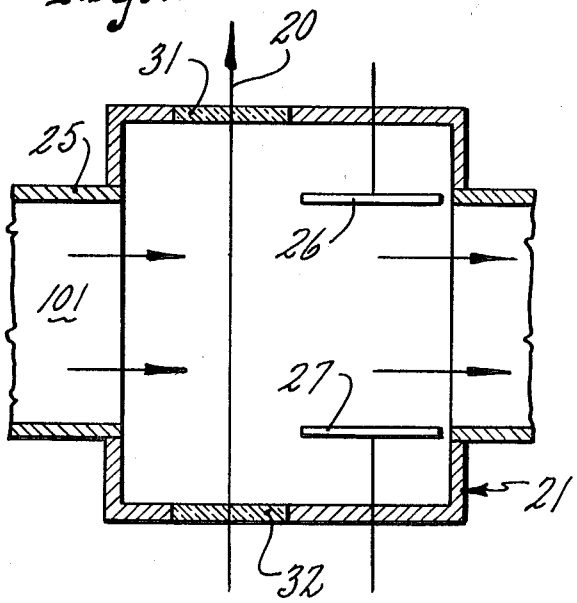
FIG. 2 shows, in partially pictorial, partially schematic form, a detail of the embodiment in FIG. 1.

FIG. 1 illustrates a gas turbine power plant system, in which combustion unit 10, illustratively a fluidized bed coal burning device, generates a hot gas stream 101 flowing through duct 11 towards gas turbine 13. In order to protect the turbine blades, it is necessary to remove as many particles of ash, unburned coal, etc., as possible. Cyclone separator 12 removes the larger particles from gas stream 101, which continues to laser separation unit 21 and then to turbine 13. Laser separation unit 21 is located within the optical cavity of a high-power laser that comprises gain unit 22 and mirrors 23 and 24 and through which beam 20 passes. The laser is illustratively a carbon dioxide laser and will include the usual power supplies, gas pumps, cooling means and other associated components that are omitted from the figure for simplicity. FIG. 2 shows a portion of unit 21 in more detail. Beam 20 passes back and forth through windows 31 and 32, traversing gas stream 101. It has been reported (Weeks and Daley, "The Interaction of TEA $Co_2$ Laser Radiation With Aerosol Particles" Applied Optics, Vol. 15, No. 11, November 1976) that radiation will impose electrical charges on particulate matter, the charges being of both polarities and having average magnitudes that depend on particle size. The charged particles may be removed from gas stream 101 by imposing an electrostatic field between plates 26 and 27, located downstream from the laser beam. The magnitude of the electric field required to overcome the viscous drag of the gas will be related to the particle parameters and to the viscosity of the gas. As an example, for a $1.2\mu$ radius alumina particle having a charge of 70 esu in a gas of viscosity $\mu=1\times10^{-4}$ poise and having a velocity of 500 cm/sec, the electrostatic force will be equal to the viscous drag when $QcE=6\pi r\mu v$, i.e., when the electric field is $4.7\times10^{3}$ volts/cm. The particles will then move at an angle of 45° with respect to the flow of gas stream 101, being collected on either of plates 26 or 27, which plates must be long enough along the direction of gas flow so that particles will reach them before being swept past. The design of grids or plates for electrostatic precipitators and the arrangement of means for removing particles attracted thereto is well known to those skilled in the art and is not indicated in the drawings.

Figure 3:
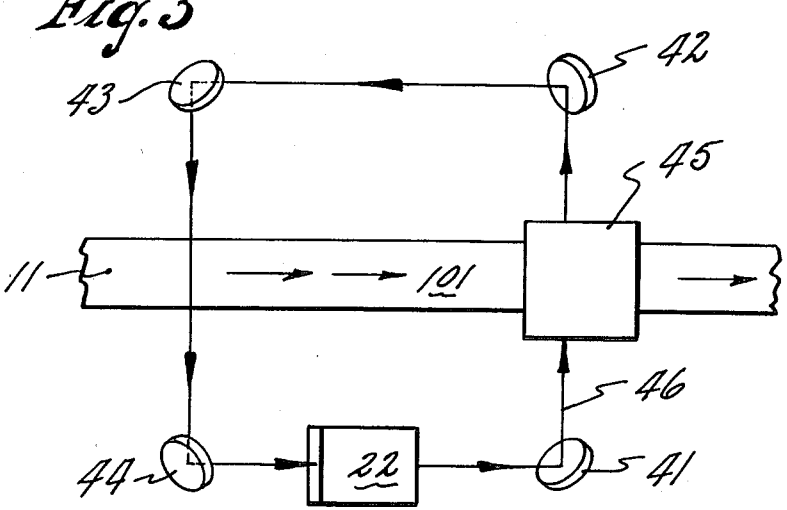
FIG. 3 shows, in partially pictorial, partially schematic form, an alternative embodiment of the invention.
Figure 4:
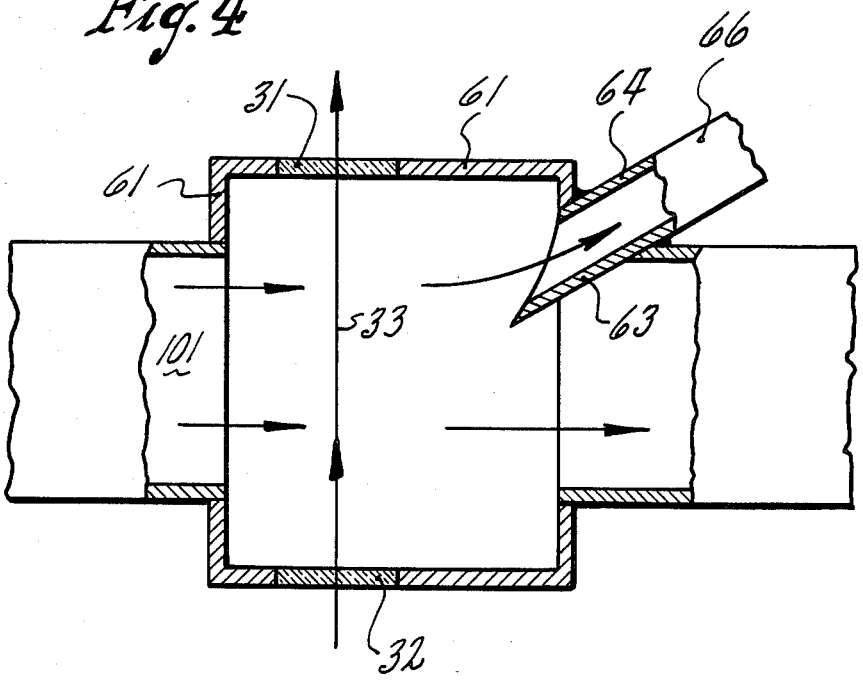
FIG. 4 shows, in partially pictorial, partially schematic form, a detail of the embodiment of FIG. 3.

An alternative embodiment of the invention is illustrated in FIG. 3, in which a ring laser configuration is employed. Duct 11, after leaving the cyclone separator, passes through laser separation unit 45, then to the turbine as before. The laser differs from the previous unit in that a beam passes through gain medium 22, is reflected by mirror 41 through unit 45, then by mirrors 42, 43 and 44 back through gain medium 22. The laser beam travels in a plane that is tilted with respect to the paper so that the beam between mirrors 41 and 42 traverses gas stream 101 and the beam between mirrors 43 and 44 passes outside duct 11, illustratively above it. In FIG. 4, gas stream 101 passes walls 61 of unit 45 and windows 31 and 32. Laser beam 33 traverses gas stream 101 in only one direction, in contrast with the previous embodiment, in which beam 20 was reflected back and forth. When beam 33 strikes a particle, energy will be transferred to the particle, the amount of energy being dependent on the number of photons, the particle size, reflectivity and a number of other parameters discussed below. The intensity of beam 33 is made high enough so that a portion of most of the particles (on the side facing window 32) is vaporized. The average force imparted to a particle due to vaporization can be calculated according to the formula $$\text{Force} = \frac{d}{dt}\, mv \cong \frac{wI\pi r^2 V_v(1-R)}{q}\,(1-e^{-r/rk})$$

where w is the average mass per particle, I the laser beam intensity, r the particle radius, $V_v$ the vapor velocity of the particle material, R the reflectivity of the particle, $r_k$ is a characteristic dimension of the particle laser interaction which takes into account diffraction effects and q is the latent heat of vaporization per atom of the particle. It is known that the velocity of vaporized material is constant over a wide range of laser intensities, (Chang, et al "High-Power Laser Radiation Interaction With Quartz", Journal of Applied Physics, Vol. 41, 12, 1970).

The vaporization force will overcome the viscous drag of the gas stream, which is $$F_{drag} = 6\pi r\mu v,$$

where $\mu$ is the gas viscosity and v is the particle velocity. Equating the recoil force from vaporization with the viscous drag permits the calculation of particle velocity $$V_{part} = \frac{wIrV_v(1-R)(1-e^{-r/rk})}{6q\mu}$$

As an example, $2\mu$ radius carbon particle in air has parameter values $w=2.5\times10^{-23}$ gm, $V_v=2\times10^5$ cm/sec, R=0, $r_k=1.6\times10^{-4}$ cm, $q=4.75\times10^{-19}$ joule/particle, $\mu=2.6\times10^{-4}$ gms $cm^{-1}sec^{-1}$ and irradiation with a $10.6\mu$ laser beam with an intensity of 500watts/$cm^2$ propels the particle along the direction of the laser beam at 400 cm/sec. For an interaction region extending 1 meter along the gas flow direction and having a dimension transverse to the plane of the paper in FIG. 2 of 10 centimeters, the laser beam will have an area of 1000 $cm^2$ and will require a circulating power of 500 kw. In contrast, cyclone separators of 500 kw are routinely used to remove the relatively large particles that they can handle.

FIG. 4 shows a cross section of a portion of interaction region 45, showing wall 61, windows 31 and 32, wall 65 and wall 62 to which is attached collection duct 66 comprising duct wall 64 and deflector 63. Beam 33 deflects particles in its direction of propagation as they are swept along by gas stream 101. If, for the above example of $2\mu$ carbon particle, the length of beam 33 along the gas flow direction is two meters and the gas velocity is 5 meters/sec, then particles closest to window 32 will be deflected by more than 1.5 meters as they pass through the laser beam. These particles concentrate near window 31 and are separated from the main portion of flow 101 by deflector 63 which extends into stream 101 and then pass down duct 65, where they are handled conventionally.

Although the invention has been described in terms of an application to a gas turbine system, it may readily be applied to pollution control problems of many kinds.

It will be understood by those skilled in this art that various changes in form and detail of the illustrated embodiments may be made without departing from the spirit and scope of the claimed invention.

We claim:

1. In a gas-turbine power plant, an apparatus for the removal of macroscopic particulate matter having an average diameter less than ten microns from a fluid stream passing between a combustion unit and a gas turbine comprising:

means for directing said fluid stream through an interaction region;

a ring laser means for generating and directing a substantially parallel optical beam through said interaction region, with an intensity of less than 10,000 watts per square centimeter, whereby at least a portion of said macroscopic particulate matter is partially vaporized and deflected transversely out of said interaction region; and means for removing said deflected portion of said particulate matter from said fluid flow.

2. An apparatus according to claim 1, in which said means for removing said deflected portion of said particulate matter includes electric means for electrically reinforcing said transverse deflection.

3. In a gas-turbine power plant, an apparatus for the removal of macroscopic particulate matter having an average diameter of less than ten microns from a gaseous stream passing between a combustion unit and a gas turbine comprising:

means for directing said gaseous stream through an interaction region;

optical means for imposing an electric charge on a portion of said macroscopic particulate matter by generating and directing a substantially parallel beam of optical radiation of predetermined intensity through said gaseous stream in said interaction region, whereby said radiation interacts with and alters the charge of said portion of said particulate matter; and electric means for removing said portion of said particulate matter from said fluid stream.

4. A method of preparing a gas stream for use as an input to a gas turbine comprising the steps of:

heating a quantity of gas in a combustion chamber, whereby macroscopic particulate matter of various sizes combines with said quantity of gas;

xtracting a stream of macroscopic particulate-laden gas rom said combustion chamber;

passing said macroscopc particulate-laden stream of gas through a mechanical cclone separator, whereby particles having a diameter greater than ten microns are effectively removed from said gas stream, leaving small macroscopic particulate matter having a diameter of less than ten microns in said gas stream;

passing said macroscopic particulate-laden gas stream through a laser interaction region and passing a substantially parallel laser beam of predetermined intensity through said gas stream, thereby ionizing a portion of said small macroscopic particulate matter; and electrically removing said ionized portion of small macroscopic particulate matter from said gas stream.

5. A method of preparing a gas stream for use as an input to a gas turbine comprising the steps of:

heating a quantity of gas in a combustion chamber, whereby macroscopic particulate matter of various sizes combines with said quantity of gas;

extracting a stream of macroscopic particulate-laden gas from said combustion chamber;

passing said macroscopic particulate-laden stream of gas through a mechanical cyclone separator, whereby particles having a diameter greater than ten microns are effectively removed from said gas stream, leaving small macroscopic particulate matter having a diameter of less than ten microns to said gas stream;

passing said macroscopic particulate-laden gas stream through a laser interaction region and passing a substantially parallel laser beam of predetermined intensity less than 10,000 watts/cm$^2$ in one direction only through said gas stream, whereby a portion of said small particulate matter is partially vaporized and deflected transversely out of said interaction region; and removing said deflected portion of small particulate matter from said gas stream.

* * * * *